US005564382A

United States Patent [19]

Arai

[11] Patent Number: 5,564,382

[45] Date of Patent: Oct. 15, 1996

[54] FUEL INJECTION SYSTEM FOR DIESEL ENGINE

[75] Inventor: Hidemi Arai, Saitama, Japan

[73] Assignee: Honda Giken Kogyo Kabushiki Kaisha, Tokyo, Japan

[21] Appl. No.: 364,625

[22] Filed: Dec. 27, 1995

[30] Foreign Application Priority Data

Dec. 27, 1993 [JP] Japan ..... 5-331595

[51] Int. Cl.[6] ..... F02B 3/00; F02M 41/16

[52] U.S. Cl. ..... 123/302; 239/96

[58] Field of Search ..... 123/302, 299; 239/96, 533.7, 5, 88, 90–96, 533.4, 533.5, 533.8

[56] References Cited

U.S. PATENT DOCUMENTS

| | | | |
|---|---|---|---|
| 2,788,246 | 4/1957 | Nichols | 239/96 |
| 4,436,247 | 3/1984 | Akagi | 239/533.7 |
| 4,807,811 | 2/1989 | Aketa et al. | 239/91 |

FOREIGN PATENT DOCUMENTS

| | | | |
|---|---|---|---|
| 2424800 | 12/1975 | Germany | 239/91 |
| 2948407 | 6/1981 | Germany | 239/91 |
| 4119467 | 12/1992 | Germany | 239/91 |
| 6353378 | 10/1988 | Japan . | |

OTHER PUBLICATIONS

European Search Report.

*Primary Examiner*—Raymond A. Nelli
*Attorney, Agent, or Firm*—Lyon & Lyon

[57] ABSTRACT

A unit injector mounted to a cylinder head in a diesel engine includes a pump section and a nozzle section which are eccentrically connected to each other through a connecting portion. An axis of the nozzle section is disposed in alignment with an axis of a cylinder, and an axis is of the nozzle section disposed on the opposite side of a pair of intake valves from the axis of the nozzle section. A rocker arm for transmitting the rotation of an exhaust cam shaft to the pump section is pivotally carried at its intermediate portion on a rocker shaft supported above the nozzle section. Thus, it is possible to provide a reduction in size of the cylinder head, while maintaining the spray of a fuel into a cylinder uniform, by an improved layout of the unit injector in the cylinder head.

3 Claims, 4 Drawing Sheets

FUEL INJECTION SYSTEM FOR DIESEL ENGINE

BACKGROUND OF THE INVENTION

1. FIELD OF THE INVENTION

The present invention relates to a fuel injection system for a diesel engine including a unit injector which is mounted in a cylinder head and which is integrally provided with a pump section for supplying a fuel and a nozzle section for injecting the fuel supplied from the pump section into a cylinder.

2. DESCRIPTION OF THE PRIOR ART

A known fuel injection system for a diesel engine including a unit injector is described in Japanese Patent Publication Laid-open No. 533378/88.

In the unit injector described in the above Patent, the pump and nozzle sections are integrally formed such that their axes are aligned with each other. The unit injector is mounted in the cylinder head such that the entire unit injector is inclined with respect to an axis of the cylinder.

If the unit injector is mounted to the cylinder head in the inclined attitude as in the above prior art system, an upper end of the unit injector protrudes sideways, and as a result, the lateral width of the cylinder head is increased, but also a nozzle hole is uneven due to the inclination of the nozzle section and hence, the spray of the fuel into a combustion chamber within the cylinder is non-uniform. When the unit injector is mounted to the cylinder head in an upright attitude in order to avoid this, if the numbers of intake and exhaust valves are increased, there is encountered a problem that the unit injector interferes with valve springs, resulting in a difficult layout. There is also a problem that the unit injector largely protrudes upwardly, resulting in an increased size of the cylinder head.

SUMMARY OF THE INVENTION

Accordingly, it is an object of the present invention to provide a reduction in size of the cylinder head, while maintaining the spray of the fuel into the cylinder uniform, by an improved layout of the unit injector in the cylinder head.

To achieve the above object, according to a first aspect and feature of the present invention, there is provided a fuel injection system for a diesel engine, comprising a unit injector which is mounted in a cylinder head including two intake valves or two exhaust valves and which is integrally provided with a pump section for supplying a fuel and a nozzle section for injecting the fuel supplied from the pump section into a cylinder, wherein axes of the pump and nozzle sections of the unit injector are axis located eccentrically, the of the nozzle section is disposed substantially in parallel to an axis of the cylinder, and the axis of the pump section is disposed on the opposite side of axis of the nozzle section with respect to the two intake valves or two exhaust valves.

With the first feature of the present invention, it is possible to reduce the height and lateral width of the cylinder head while preventing an interference of the unit injector with the valves and moreover to uniformize the fuel injected from the nozzle section into the cylinder.

According to a second aspect and feature of the present invention, there is provided a fuel injection system for a diesel engine, comprising a unit injector which is mounted in a cylinder head and which is integrally provided with a pump section for supplying a fuel and a nozzle section for injecting the fuel supplied from the pump section into a cylinder, wherein axes of the pump and nozzle sections of the unit injector are located eccentrically, and the system further includes a rocker arm pivotally carried at an intermediate portion thereof on a rocker shaft disposed above the nozzle portion for driving the pump section, and a cam shaft disposed on the opposite side of the pump section with respect to the nozzle section for driving the rocker arm.

With the second feature of the present invention, it is possible to easily dispose the rocker arm in a space above the unit injector to suppress the entire height of the cylinder head to a low level.

In addition to the first or second feature, according to a third feature of the present invention, an upper half of the nozzle section and a lower half of the pump section of the unit injector are overlapped on each other as viewed from the side.

With the third feature of the present invention, it is possible to suppress the entire height of the unit injector to reduce the size of the cylinder head.

The above and other objects, features and advantages of the invention will become apparent from the following description of a preferred embodiment taken in conjunction with the accompanying drawings.

DESCRIPTION OF THE PREFERRED EMBODIMENT

The present invention will now be described by way of a preferred embodiment with reference to the accompanying drawings.

Figure 1:
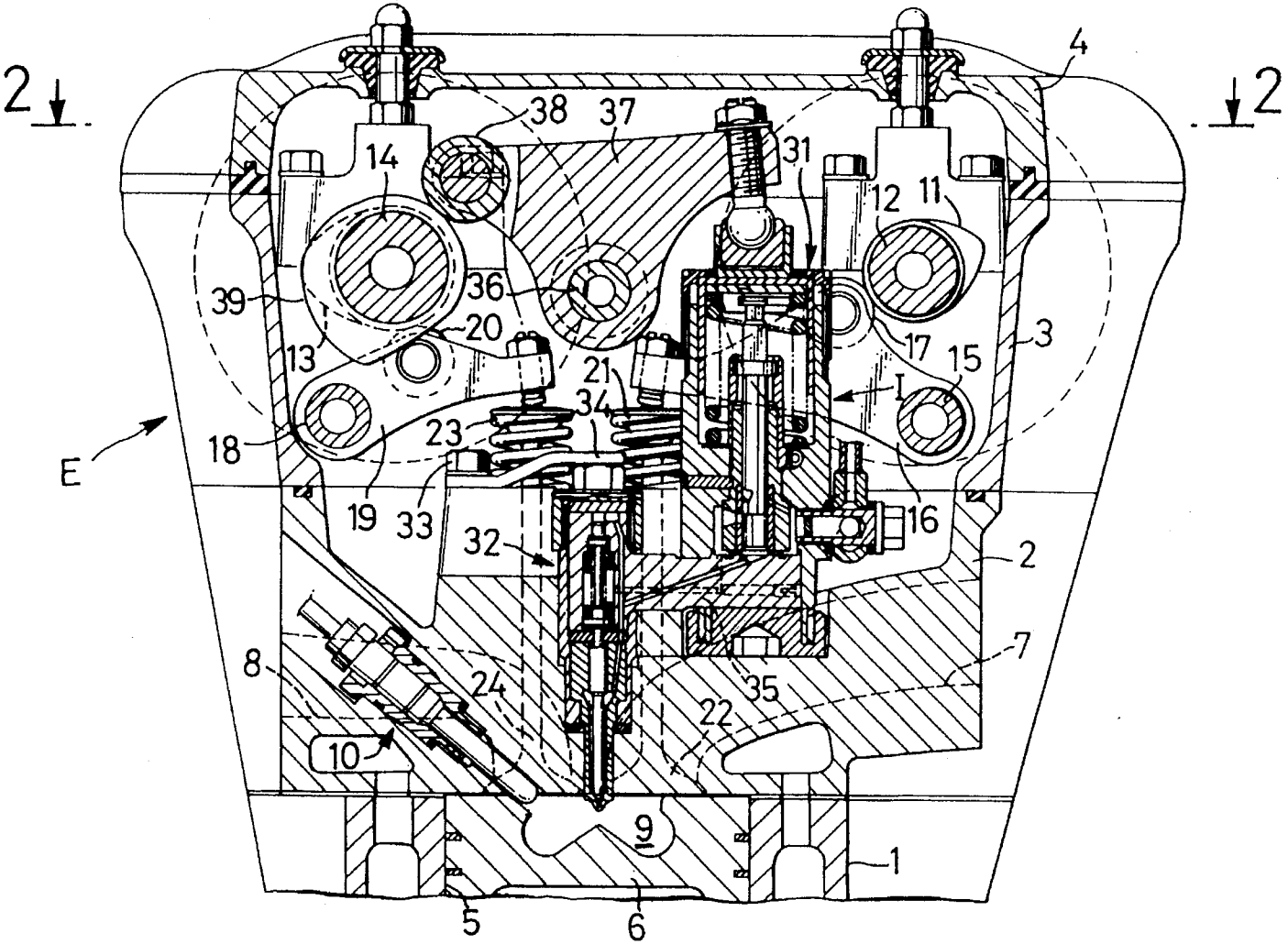
FIG. 1 is a vertical sectional view of a cylinder head area in a diesel engine (a sectional view taken along a line 1—1 in FIG. 2)
Figure 2:
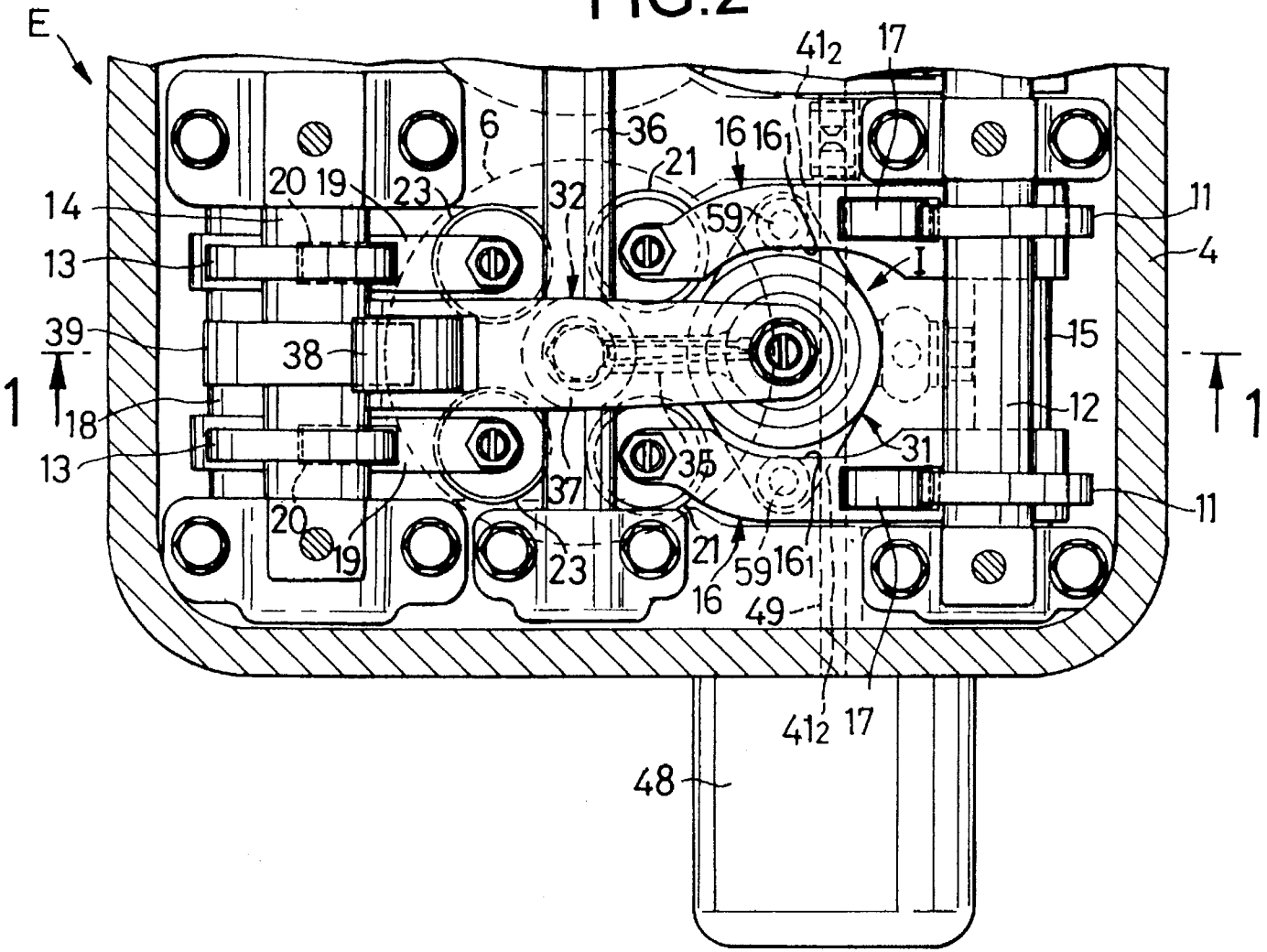
FIG. 2 is a view taken along a line 2—2 in FIG. 1.

Referring to FIGS. 1 and 2 illustrating a first embodiment, a diesel engine E includes a cylinder head 2 coupled in a stacked manner to a deck surface of a cylinder block 1, a cam case 3 and a head cover 4. A piston 6 is slidably received in a cylinder 5 defined in the cylinder block 1, and a combustion chamber 9 is defined between a lower surface of the cylinder head 2 and an upper surface of the piston 6 and connected to an intake port 7 and an exhaust port 8. A nozzle 53 of a unit injector 1 which will be described hereinafter projects into a central portion of the combustion chamber 9, and a tip end of a glow plug 10 projects into a side portion of the combustion chamber 9.

An intake cam shaft 12 having a pair of intake cams 11, 11 and an exhaust cam shaft 14 having a pair of exhaust cams 13, 13 are rotatably supported in the cam case 3. The intake cams 11, 11 abut against cam followers 17, 17 of intake rocker arms 16, 16 which are pivotally supported in the cam case 3 through an intake rocker shaft 15. The exhaust cams 13, 13 abut against cam followers 20, 20 of exhaust rocker arms 19, 19 which are pivotally supported in the cam case 3 through an exhaust rocker shaft 18. Tip ends of the intake rocker arms 16, 16 abut against upper ends of stems of a pair of intake valves 22, 22 which are slidably supported in the cylinder head 2 and biased in closing directions by spring forces of intake valve springs 21, 21. Tip ends of the exhaust rocker arms 19, 19 abut against upper ends of stems of a pair of exhaust valves 24, 24 which are slidably supported in the cylinder head 2 and biased in closing directions by spring forces of exhaust valve springs 23, 23.

Thus, if the intake cam shaft 12 and the exhaust cam shaft 14 are rotated in operative association with the rotation of the crankshaft, the intake valves 22, 22 are opened and closed through the intake cams 11, 11 and the intake rocker arms 16, 16, and the exhaust valves 24, 24 are opened and closed through the exhaust cams 13, 13 and the exhaust rocker arms 19, 19.

The structure of the unit injector I will be described below with reference to FIG. 3 in addition to FIGS. 1 and 2.

The unit injector I includes a pump section 31 and a nozzle section 32 which are integrally coupled to each other. The nozzle section 32 is formed into a substantially cylindrical shape. The nozzle section 32 is fitted from above to a mounting seat of the cylinder head 2 such that an axis of the nozzle section 32 is aligned with an axis of the combustion chamber 9. And the nozzle section 32 is fixed such that its upper end is pressed onto a fixing plate 34 which is coupled to the cylinder head 2 by a bolt 33. As can be seen from FIG. 2, the nozzle section 32 is disposed at a location surrounded by the pair of intake valve springs 21, 21 and the pair of exhaust valve springs 23, 23. By disposing the nozzle section 32 in an upright position in a central portion of the combustion chamber 9 with the axis of the nozzle section 32 substantially parallel to an axis of the cylinder 5 in the above manner, a plurality of injection bores provided in the nozzle section 32 can be uniformized in shape to uniformize the spray of a fuel within the combustion chamber 9.

Figure 3:
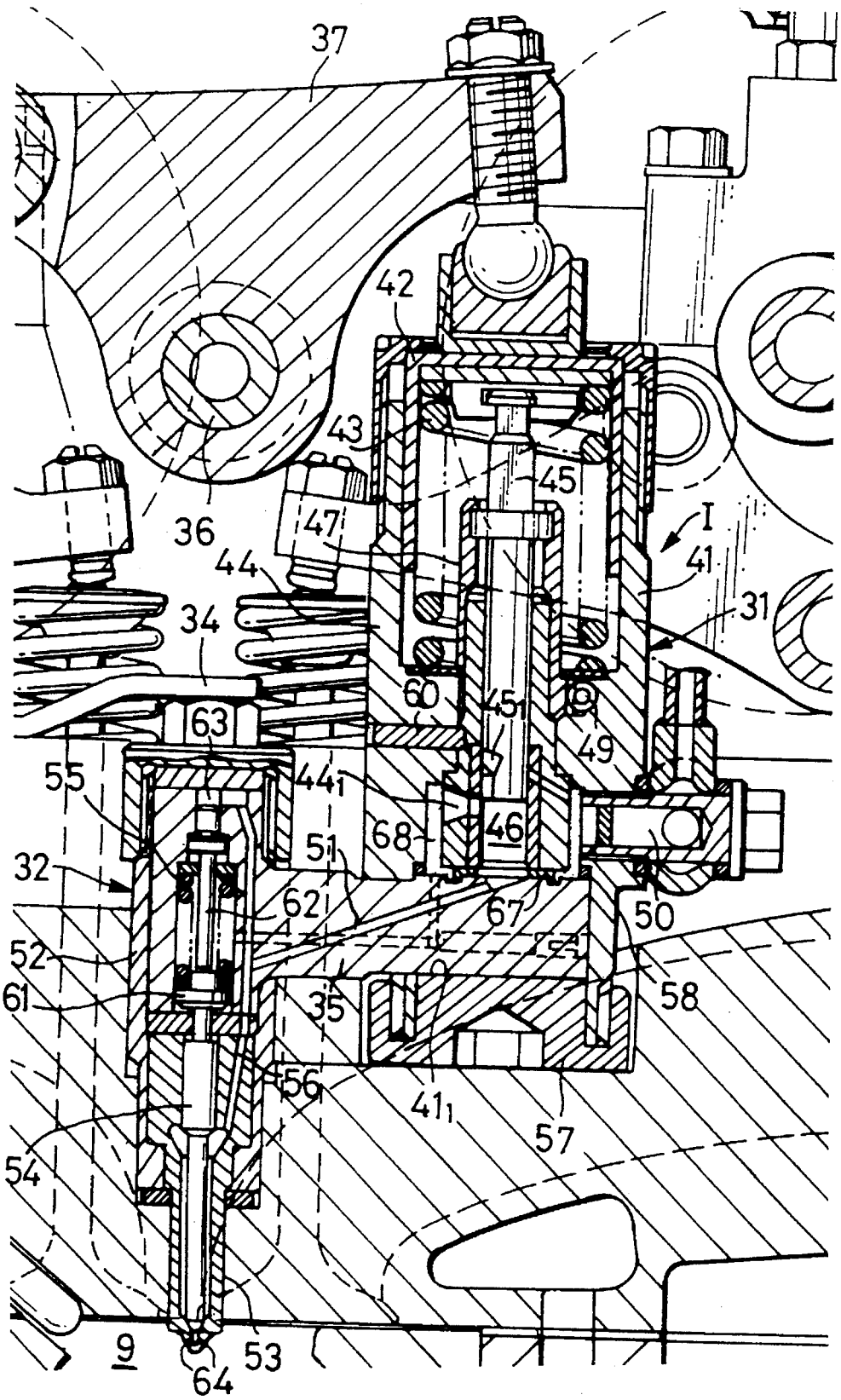
FIG. 3 is an enlarged view of an essential portion shown in FIG. 1.

An axis of the pump section 31 of the unit injector I is eccentric rightwardly as viewed in FIGS. 2 and 3 (toward the intake valves 22, 22). The pump section 31 and the nozzle section 32 are interconnected by a connecting portion 35 disposed between the pair of intake valve springs 21, 21. The pump section 31 formed into a substantially cylindrical shape is disposed between the pair of intake rocker arms 16, 16. In order to prevent an interference with the pump section 31, an arcuate recess $\mathbf{16}_1$ is defined in a side of each of the intake rocker arms 16, 16 adjacent the pump section 31 (see FIG. 2).

As described above, the nozzle section 32 and the pump section 31 of the unit injector I are disposed in upright attitudes such that the two intake valves 22, 22 are sandwiched therebetween. Therefore, an interference of the intake valve springs 21, 21 with the unit injector I can be avoided and moreover, the unit injector I does not project laterally and thus, a lateral width of the cylinder head 2 is not increased. In addition, an upper half of the nozzle section 32 and lower half of the pump section 31 are overlapped with each other as viewed from the side. Thus, it is possible to suppress the entire height of the unit injector I to a low level, as compared with a case where the nozzle section 32 and the pump section 31 are coaxially coupled to each other. Further, since the pump section 31 is defined on the side of the intake valves 22, 22, it is possible to reduce the heat load due to an exhaust gas, as compared with a case where the pump section 31 is disposed on the side of the exhaust valves 24, 24.

A rocker shaft 36 for the unit injector I is supported above the nozzle section 32 of the unit injector I in parallel to the intake cam shaft 12 and the exhaust cam shaft 14. A cam follower 8 is provided at one end of a unit injector rocker arm 37 pivotally carried on the rocker shaft 36 for the unit injector, and abuts against a unit injector cam 39 provided on the exhaust cam shaft 14. By utilizing a space above the nozzle section 32 reduced in height by eccentrically locating the pump section 31, the unit injector rocker arm 37 can be easily disposed therein, thereby suppressing the entire height of the cylinder head 2 to a low level.

The pump section 31 of the unit injector I includes a tappet 42 slidably carried in an upper portion of a cylindrical housing 41 to abut against the other end of the unit injector rocker arm 37, a return spring 43 for the tappet 42, a cylinder 44 provided within the housing 41, a pin 60 for preventing the rotation of the cylinder, a plunger 45 slidably received in the cylinder 44 with its upper end abutting against a lower surface of the tappet 42, a sleeve 47 relatively rotatably fitted over an outer periphery of the cylinder 44 for rotation in unison with the plunger 45, a control rack 49 for reciprocal movements by an actuator 48 (see FIG. 2) to rotatably drive the sleeve 47, a fuel supply passage 50 through which a fuel is supplied to a pressure chamber 46, and a feed passage 51 extending from the pressure chamber 46 to the nozzle section 32.

The connecting member 35 is fitted in an opening $\mathbf{41}_1$ in the housing 41 and fixed to the housing 41 by threadedly fitting a fixing member 57 thereto. The housing 41 is fixed to the cylinder head 2 by fastening a pair of flange portions $\mathbf{41}_2$, $\mathbf{41}_2$ of the housing 41 to the cylinder head 2 by bolts 59, 59 (see FIG. 2).

A lower portion of the cylinder 44 is in abutment against the connecting portion 35 through a seal washer 67, and the housing 41 and the connecting portion 35 are in abutment against each other through a seal member 58, whereby a fuel chamber 68 is kept liquid-tight.

Figure 4:
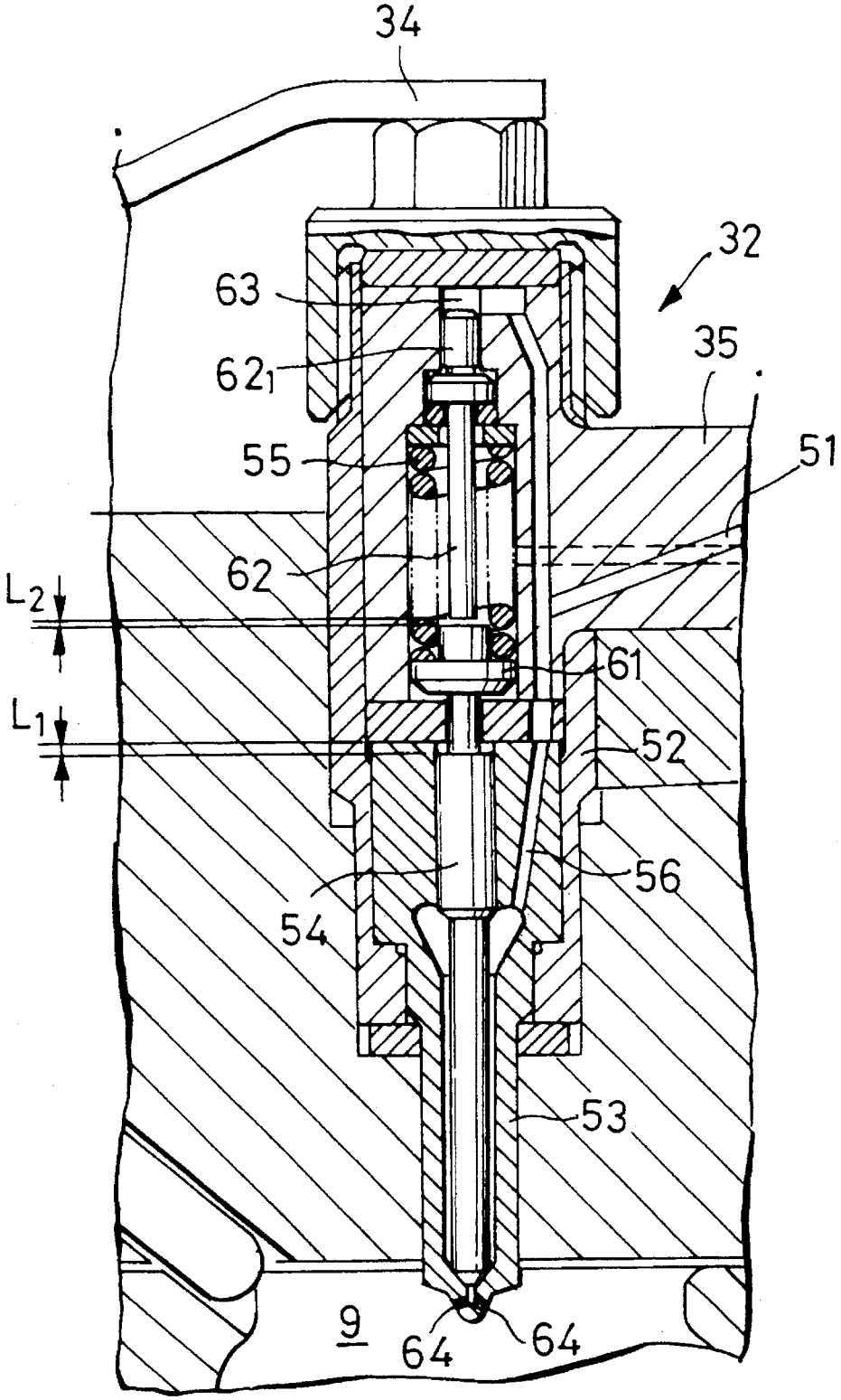
FIG. 4 is an enlarged view of an essential portion shown in FIG. 3.

As can be seen from FIG. 4, the nozzle section 32 of the unit injector I includes a cylindrical housing 52, a nozzle 53 provided at a lower portion of the housing 52 to extend into a central portion of the combustion chamber 9, a needle valve 54 vertically movably received in the nozzle 53 with a predetermined gap left therebetween, a spring 55 for biasing the needle valve 54 downwardly, and a feed passage 56 connected to the feed passage 51 and communicating with the gap between the nozzle 53 and the needle valve 54.

The needle valve 54 is urged against the nozzle 53 through a retainer 61 biased by the spring 55, so that a nozzle hole 64 in the nozzle 53 is closed by a tip end of the needle valve 54. A central plunger 62 is provided in a central portion of the spring 55 such that a predetermined gap $L_2$ is left between the central plunger 62 and the retainer 61. And a back pressure chamber 63 is defined at an upper end of the central plunger 62 to communicate with the feed passage 51, thereby permitting a feed pressure to he applied to a piston portion $\mathbf{62}_1$ of the central plunger 62.

The operation of the embodiment of the present invention having the above-described construction will be described below.

When the cam follower 38 is urged against the unit injector cam 39 provided on the exhaust cam shaft 14 to reciprocatively swing the unit injector rocker arm 37, the tappet 42 provided at the upper end of the housing 41 of the pump section 31 is reciprocatively driven. When the plunger 45 urged against tappet 42 is moved downwardly within the cylinder 44 to close a port $\mathbf{44}_1$ connected to the fuel supply passage 50, an effective stroke of the plunger 45 is started, thereby causing the fuel in the pressure chamber 46 pressurized to a lower surface of the plunger 45 to be supplied through the feed passage 51 and the feed passage 56 into the gap between the nozzle 53 of the nozzle section 32 and the needle valve 54.

If the pressure of the supplied fuel is risen to exceed a predetermined value, the needle valve 54 is lifted against a force of the spring 55, thereby causing a small lift $L_2$ of the retainer 61, until the latter abuts against the central plunger 62, so that an initial injection of the fuel is performed by this small lift. During this time, the feed pressure applied to the back pressure chamber 63 urges the piston portion $\mathbf{62}_1$ of the central plunger 62 to bias the needle valve 54 in a closing direction.

If the feed pressure is further risen, the needle valve 54 is lifted in a largest lift amount $L_1$ larger than the $L_2$, thereby causing a large amount of the fuel to be injected from the nozzle hole 64. By reducing the amount of fuel initially injected in this manner, the combustion noise can be reduced and the combustion can be stabilized to provide an enhanced emission characteristic. Particularly, a two-stage injection nozzle using the central plunger 62 has an increased entire height, and therefore, it is possible to provide an effective compactification by separating the pump section 31 and the nozzle section 32 from each other as in this embodiment.

If the plunger 45 is rotated along with the sleeve 47 by driving the control rack 49 by the actuator 48 in order to change the amount of fuel injected, the position relationship between a notch $\mathbf{45}_1$ provided at a lower end of the plunger 45 and the port $\mathbf{44}_1$ in the pressure chamber 46 is changed. As a result, the timing of closing the port $\mathbf{44}_1$ by the plunger 45 is changed to change the effective stroke of the plunger 45, thereby controlling the amount of fuel injected.

In general, in a unit injector integrally provided with pump and nozzle sections such that their axes are aligned with each other, a load for urging the plunger is transmitted from a portion of the housing of the pump section fixed to the cylinder head to the cylinder head and from the nozzle section through the seal washer to the cylinder head. However, the wall thickness of the cylinder head in this area is small and therefore, it is feared that the cylinder may be flexed to change the effective stroke and as a result, the amount of fuel injected may be changed. Particularly, in an injection nozzle with a small initial stroke as in the two-stage injection nozzle, there is a possibility that an influence of the small initial stroke is largely revealed. It is conceived as a countermeasure therefor that the wall thickness of the cylinder head is increased, but the height of the unit injector is increased by an amount corresponding to this wall thickness increment, resulting in a difficulty of layout.

Therefore, if the pump section 31 and the nozzle section 32 are eccentrically provided as in this embodiment, the load of the plunger can be received by the increased-thickness portion of the cylinder head, thereby avoiding the application of the load to the nozzle section 32 to prevent the variation in amount of fuel injected.

Although the embodiment of the present invention has been described in detail, it will be understood that the present invention is not limited to the above-described embodiment, and various modifications in design may be made without departing from the spirit and scope of the invention defined in claims.

For example, although the pump section 31 of the unit injector I is eccentric toward the intake valves 22, 22 in the embodiment, it may be eccentric toward the exhaust valves 24, 24. In addition, the number of the valves (the exhaust valves in the embodiment) located on the opposite side from the eccentric pump section 31 need not be necessarily two, but may be one.

What is claimed is:

1. A fuel injection system for a diesel engine, comprising a unit injector which is mounted in a cylinder head including two intake valves or two exhaust valves and which is integrally provided with a pump section for supplying a fuel and a nozzle section for injecting the fuel supplied from said pump section into a cylinder, wherein axes of said pump and nozzle sections of said unit injector are located eccentrically, the axis of said nozzle section is disposed substantially in parallel to an axis of said cylinder, and the axis of said pump section is disposed on an opposite side of said axis of said nozzle section with respect to said two intake valves or two exhaust valves.

2. A fuel injection system for a diesel engine, comprising a unit injector which is mounted in a cylinder head and which is integrally provided with a pump section for supplying a fuel and a nozzle section for injecting the fuel supplied from the pump section into a cylinder, wherein axes of said pump and nozzle sections of said unit injector are located eccentrically, and wherein a rocker arm is pivotally carried at an intermediate portion thereof on a rocker shaft disposed above said nozzle portion for driving said pump section, and a cam shaft is disposed on an opposite side of said pump section with respect to said nozzle section for driving said rocker arm.

3. A fuel injection system for a diesel engine according to claim 1 or 2, wherein an upper half of said nozzle section and a lower half of said pump section of said unit injector are overlapped on each other as viewed from a side.

* * * * *

UNITED STATES PATENT AND TRADEMARK OFFICE

CERTIFICATE OF CORRECTION

PATENT NO. : 5,564,382

DATED : October 15, 1996

INVENTOR(S) : H.Arai

It is certified that error appears in the above-indentified patent and that said Letters Patent is hereby corrected as shown below:

Title Page, Box [22], change the filing date "Dec. 27, 1995" to read -- Dec. 27, 1994 ---.

Signed and Sealed this

Tenth Day of November 1998

*Attest:*

Bruce Lehman

BRUCE LEHMAN

*Attesting Officer*

*Commissioner of Patents and Trademarks*